US005292008A

United States Patent [19]

Sansone et al.

[11] Patent Number: 5,292,008

[45] Date of Patent: Mar. 8, 1994

[54] POSTAL TRAY LABEL APPARATUS AND METHOD

[75] Inventors: Ronald P. Sansone; Robert P. Kemper, Weston, both of Conn.

[73] Assignee: Pitney Bowes Inc., Stamford, Conn.

[21] Appl. No.: 967,333

[22] Filed: Oct. 28, 1992

[51] Int. Cl.[5] ..... B07C 5/00

[52] U.S. Cl. ..... 209/584; 209/900

[58] Field of Search ..... 209/546, 547, 551, 552, 209/584, 900; 198/358, 958; 364/478, 479

[56] References Cited

U.S. PATENT DOCUMENTS

| | | | |
|---|---|---|---|
| 4,507,739 | 3/1985 | Haruki et al. | 209/900 X |
| 4,655,026 | 4/1987 | Wigoda | 364/479 X |
| 4,769,110 | 9/1988 | Ohno et al. | 209/900 X |
| 5,042,667 | 8/1991 | Keough | 209/584 X |

FOREIGN PATENT DOCUMENTS 0095737 12/1983 European Pat. Off. .

*Primary Examiner*—H. Grant Skaggs
*Assistant Examiner*—Carol Lynn Druzbick
*Attorney, Agent, or Firm*—Peter Vrahotes; Melvin J. Scolnick

[57] ABSTRACT

An apparatus and method for providing labels that are to be inserted into mail trays. A label printer is integrated into a mail sorting machine. Upon a specific bin of the mail sorting machine having sufficient mail pieces to fill a mail tray, the label printer prints a tray label for the mail in such bin. This tray label has printed thereon the zip code to which the mail is to be sent and the bin number in which the mail pieces are located. Upon the printing of such tray label, it is be conveyed by the mail sorter to the appropriate bin and is immediately available to the clerk for insertion into a mail tray.

4 Claims, 2 Drawing Sheets

POSTAL TRAY LABEL APPARATUS AND METHOD

RELATED CASES

Attention is directed to co-pending U.S. patent application Ser. No. 07/594,515 filed Oct. 9, 1990 and entitled: METHOD AND APPARATUS FOR PREPARING VALIDATED MAIL TRAY LABELS; U.S. patent application Ser. No. 07/641,985 filed Jan. 16, 1991, now abandoned, and entitled: POSTAL AUTOMATED LABELING SYSTEM; U.S. Pat. No. 5,216,620, filed Sep. 23, 1991 and entitled: REQUESTING, REPORTING AND VERIFICATION SYSTEM AND METHOD FOR MAIL CARRIER PAYMENT; and U.S. Pat. No. 5,142,483 filed Nov. 4, 1991 and entitled: MAILING SYSTEM WITH INFORMATION FEED BACK.

BACKGROUND OF THE INVENTION

Field of the Invention

In the processing of mail on the floor of a post office or in the mail room of a mailer, sorters are known that sort mail in accordance with the destination of such mail. The most common form of sorter is a bar code sorter wherein mail is sorted in accordance with a bar code printed thereon, whether such bar code be the postnet bar code or a full size bar code. Sorters have a large number of bins into which mail pieces are placed, for example, as many as three hundred binds, each bin receiving mail pieces for a designated destination. For example, a post office in New York City will have bins which individually will receive mail pieces for a specific zip code within New York City, bins that individually will receive mail pieces of for towns in the area of New York City and bins that will receive mail for mail distribution centers in other parts of the country. The mail in the bins are put into trays or sacks for subsequent processing.

Description of Related Art

One of the most time consuming activities in processing mail is in applying labels to mail trays to identify the destination of the contents of the mail trays. Past practice had been for the post office, or mailers, to have preprinted labels in a cabinet where a clerk could select an appropriate label. This had two distinct disadvantages: the clerk could select the wrong label by error, and an inventory had to be maintained. In U.S. patent application No. 07/641,985, supra, a scheme is proposed whereby a hand held label printer could be used to print mail tray labels. In this scheme, the label printer is programmed with the same sortation plan under which the associated sorting machine is operating. In U.S. patent application No. 07/594,515, supra, a label printer is provided downstream from a mail processing apparatus and the main frame computer which controls the preparation of mail pieces also controls the printing of the tray labels. This particular process involves the preparation of mail rather than the sorting of mail and is directed to large mailers who have high quantities of mail going to given destinations. U.S. patent application Ser. No. 07/763,787, supra, provides both a label printer that produces a label that is attached to mail trays by a large volume mailer and a tag printer for printing tags that are attached to a sack of mail. The tag is for the benefit for the common carrier as well as the mailer who will be assured the tagging is performed correctly as it is under his control. U.S. patent application Ser. No. 07/785,910, supra, discloses a system and method for preparing mail pieces and subsequently printing a label to be placed on a tray.

Although the above systems work well and have advanced the art, most have been directed to use by mailers for assisting in preparing large volumes of mail rather than to a sorting operation. In addition, all of the systems generally provide a tray label after mail processing is complete and the label is printed independently of the processing of the mail.

It clearly would be advantageous if the printing of a tray label could be accomplished during the sorting of the mail whereby a clerk need not go through extra effort to obtain an appropriate tray label, thus enhancing accuracy and saving time.

SUMMARY OF THE INVENTION

A scheme has been conceived involving apparatus and method for providing mail destination identifying labels for a mail tray automatically. A label printer is integrated into a mail sorter that will print a label for a mail tray. Upon a bin of the mail sorter having sufficient mail pieces to fill a tray, the printer prints a tray label and the sorter conveys the label to the appropriate bin. Upon the label being received at the bin, the operating clerk empties the contents of the bin into the mail tray and will have the mail tray label at his disposal for immediate insertion into the label slot of the mail tray. A mail tag form is provided that has the postnet bar code or other appropriate code thereon for sorting purposes and a separable mail tray label portion for attachment to a mail tray. The mail tray label portion is attached to the main part of the label form by a perforated section, so as to be readily separated by the clerk.

DETAILED DESCRIPTION OF THE PREFERRED EMBODIMENTS

Figure 1:
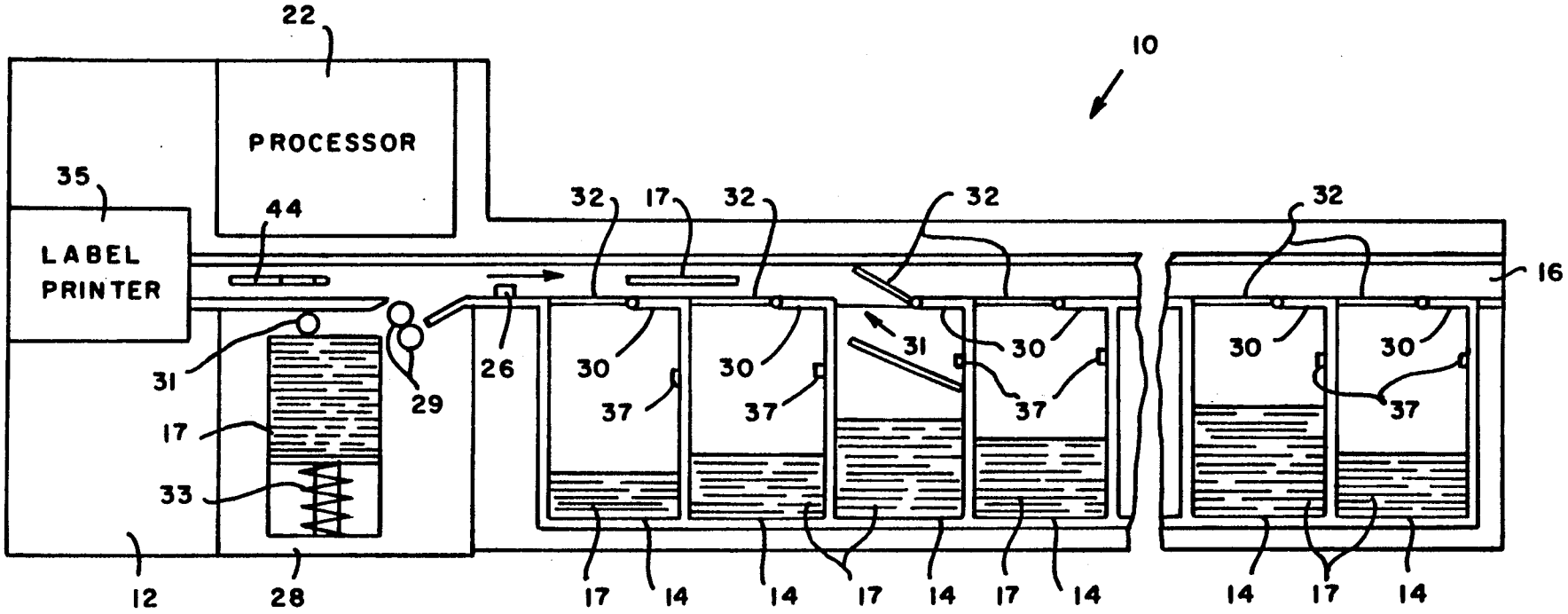
FIG. 1 is a block diagram of a bar code sorter in which the instant invention can be utilized.
Figure 3:
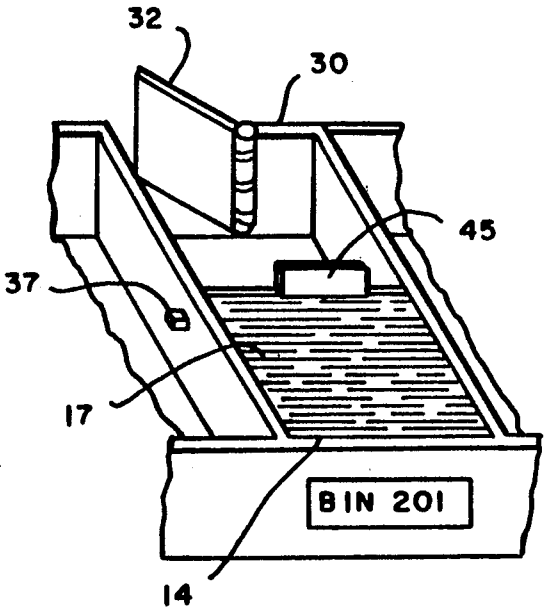
FIG. 3 is a perspective view of a bin with mail and a mail tag form therein.

Referring now to FIGS. 1 and 3, a bar code sorter is shown generally at 10 and includes a table 12 that supports a plurality of bins 14. Each of the bins 14 is for the purpose of receiving mail pieces destined for a specific destination. The sorter 10 has a belt 16 that is driven by appropriate means (not shown) for the purpose of conveying mail pieces 17 in the direction as shown by the arrow. A processor 22 having sort plans programmed therein is supported by the table 12 and is in communication with a bar code reader 26 that is immediately downstream from a loading table 28. The loading table 28 has a pair of drive rollers 29 that is downstream from a stack of mail pieces 17 that are to be sorted. The mail pieces 17 to be sorted are urged against a separating roller 31 by a spring 33. A plurality of partitions 30 are located along the length of the conveyor belt 16 and define openings 31 with gates 32 located in each opening. The gates 32 are in communication with the processor 22 to be controlled thereby.

What has been described up to this point is typical of bar code reader/sorters that are commercially available. Details of bar code reader/sorters can be found in U.S. Pat. Nos. 4,146,175 and 4,432,448.

Upstream from the loading table 28 is a label printer 35 that is in communication with the processor 22. In addition, each bin 14 has located therein a sensor 37 that senses when a defined quantity of mail is located within the respective bin. The term defined quantity of mail is used to define a sufficient amount of mail that will fill the length of a mail tray when the mail pieces are placed face to back in a bin. These sensors 37 are in communication with the processor 22, and can be either mechanical or optical in nature. Such sensors are well known and will not be described in detail. Alternatively, a defined quantity of mail can be calculated by the processor 22 based upon the number of inserts and mailpieces and the number of mailpieces. Also, the operating clerk can activate the printer 35 manually as by activating a switch button.

Figure 2:
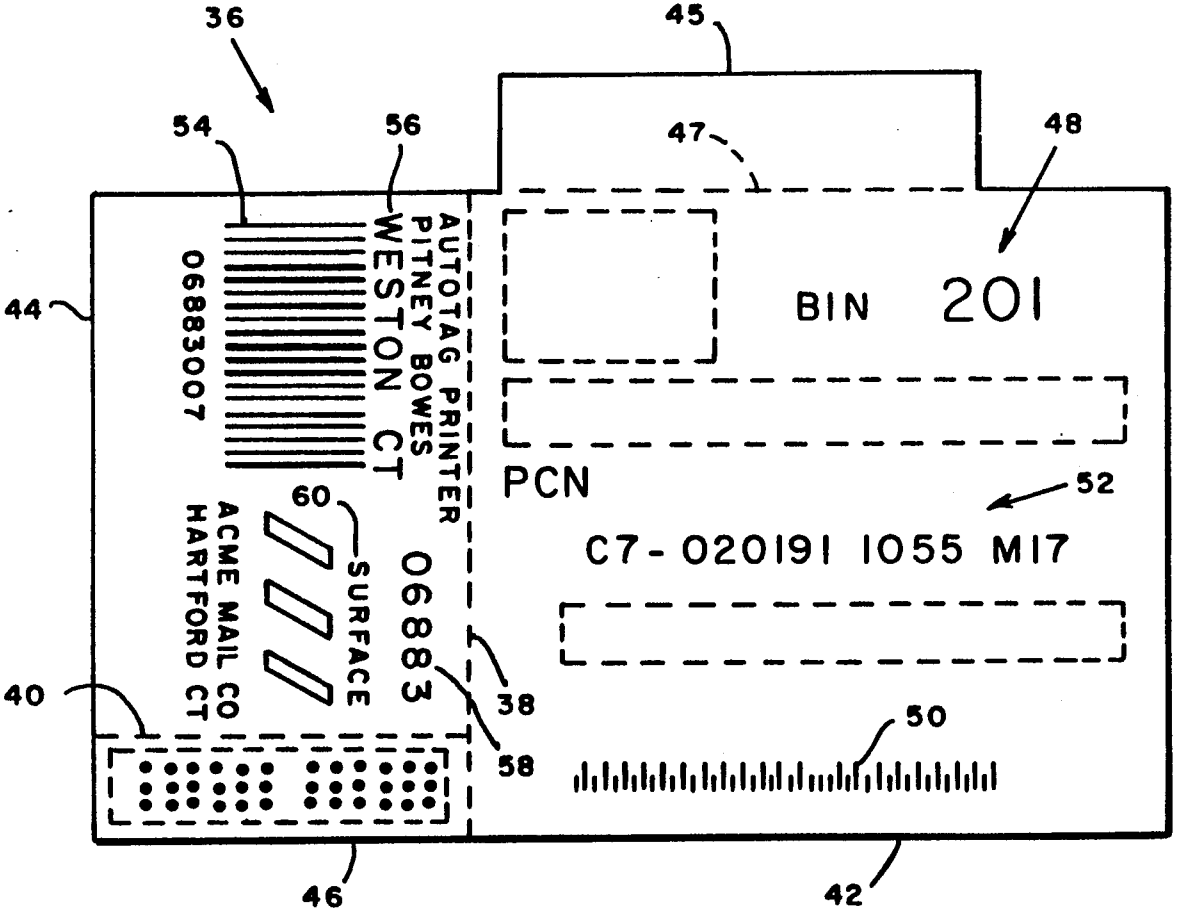
FIG. 2 is a plan view of a mail tag form that can be used in practicing the instant invention.

With reference to FIGS. 2 and 3, a mail tag form 36 is shown that is printed by the printer 35. The mail tag form 36 is made of three portions that are separated by perforations 38 and 40. These portions include the bin identification portion 42, the tray label portion 44 and a third portion 46 that can be used for miscellaneous purposes such as providing inventory information (of tags and envelopes), piece count, demographics and the like. The mail tag form 36 can optionally have a tab portion 45 that is also connected by a perforated portion 47. The tab 45 assists a clerk in recognizing the presence of a mail tag form 36, although this may be accomplished by having the tag 42 sufficiently large so it can be readily seen without the tag.

The bin identification portion 42 of the mail tag form 36 includes the bin number 48, the postnet bar code 50 and a series of alpha numerics 52 that represent identification of the mail run for the benefit of the mailer. It will be noted that the code printed on the mail tag form 36 by the printer 35 is of the same type of code that is printed on mail pieces. The particular code will be the one designated for the specific bin in this case bin 201. More specifically, all the mail pieces received in bin 201 will have a code combination printed thereon that is printed the same as the code combination printed on the label form so that the mail in bin 201 will be sent to a common processing facility.

The tray label portion 44 has printed thereon a barcode 54, the destination of the mail in the tray to which the label is to be attached 56 and a zip code 58 that correlates with the postnet bar code on the bin identification portion 42. The tag label portion 44 may also contain other designations, such as, to show how the mail is to be shipped or information that may be required by the post office. In this example, the mail is to be shipped by surface 60.

In operation, mail pieces 62 will be loaded onto the loading table 28, fed to the separating rollers 29 to be singulated, and conveyed by belt 16 past the reader 26. The reader 26 communicates to the processor 22 the information read from the bar code on a mail piece and the sorter initiates a gate 32 for the particular bin 14 that is to receive mail pieces with that particular bar code designation. This process continues until a quantity of mail is received within a bin that is sufficient to fill a tray. Upon this occurring, the sensor 37, or other mentioned means, sends a signal to the processor 22 indicating that the bin 14 has a defined quantity of mail. Knowing the bin 14 which has the defined quantity of mail, the processor 22 will then command the printer 35 to print a mail tag form 36 such as that shown in FIG. 2. In this particular instance, bin 201 has a sufficient quantity of mail to fill a tray and the destination of the mail in that bin is Weston, Conn. It will be appreciated that the quantity of mail required to fill a tray is not precise so that if additional mail pieces are placed into a bin 14 before a mail tag form 36 arrives no problem is created. The label printer 35 prints the appropriate information on the mail tag form 36 and places the form onto the conveyor 16 where it will be conveyed into bin 201 as a result of the processor activating the gate 32 for bin 201. Upon seeing a mail tag form 36 in a bin, the clerk will remove the contents of the bin and place such contents into a mail tray. The clerk will then remove the mail tag form 36, separate the tray label portion 44 from the other two portions 42, 46 and place the detached tray label 44 into the label receiving slot of the tray. The clerk will then place the two portions 46,48 at selected locations as may be designated and discard the tab portion 45.

With the instant invention, the clerk has the tray label 44 available to him immediately upon a bin 14 of a mail sorter 10 receiving a quantity of mail sufficient to fill a tray. In this way, the clerk need not read the bin number and need not have to resort to a pigeon hole type cabinet where a plurality of presorted labels are stored. The mail, thus, is processed in a faster and more reliable manner.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. Apparatus for sorting mail and providing mail tray label forms, comprising:

a processor, a plurality of bins, a conveyor for conveying mail pieces and mail tray label forms past said plurality of bins, deflecting members in communication with said processor for deflecting selected mail pieces and mail tray label forms into said plurality of bins, a sensor in communication with said processor for determining the presence of a defined quantity of mail pieces in a bin of said plurality of bins, a label printer adjacent said conveyor and in communication with said processor for placing a mail tray label form of said mail tray label forms on said conveyor, whereby upon said sensor sensing said defined quantity of mail pieces in a bin, said printer prints a label for said bin and places the mail tray label form said conveyor to be conveyed to said bin.

2. Apparatus for sorting mail and providing mail tray label form, comprising:

a processor, a plurality of bins, a conveyor for conveying mail pieces and mail tray label forms past said plurality of bins, deflecting members line for each of said plurality of bins, for deflecting mail pieces and mail tag forms from said conveyor into said plurality of bins, a reader in communication with said deflecting members for reading a code on the mail pieces and mail tray label forms, a sensor in communication with said processor for determining the presence of a defined quantity of mail pieces in a bin of said plurality of bins, a label printer adjacent said conveyor and in communication with said sensor for placing a mail tray label form of said mail tray label forms on said conveyor whereby upon said sensor sensing said defined quantity of mail pieces in a bin, said printer prints a code on a mail tray label from corresponding to the code, on mail in said bin, and places said mail tray label form on said conveyor an said reader reads the code on the mail tray label form and activates the deflection member of a said bin whereby the said label form deflected into said bin.

3. A method of sorting mail and providing a mail tray label, the steps comprising:

conveying mail pieces on a conveyor past a plurality of bins, deflecting mail pieces into said bins, in accordance with codes printed on said mail pieces, sensing a defined quantity of mail pieces in a bin of said plurality of bins, printing a code and destination information on a mail tray label for said bin, and conveying the mail label tray on said conveyor to said bin and deflecting the mail tray label into said bin 4. A method of sorting mail and providing a mail tray label, the steps comprising:

a) conveying code bearing mail pieces past a plurality of bins, b) reading the codes on the mail pieces, c) deflecting the mail pieces into said bins in response to the read codes, d) determining the presences of a defined quantity of mail pieces in a bin of said plurality of bins, e) printing a label form for said bin, f) conveying the label form to said bin, g) placing the defined quantity of mail pieces in a mail tray, and h) attaching at least a portion of the label form to the mail tray.

* * * * *